US006817169B2

(12) United States Patent
Straaten

(10) Patent No.: US 6,817,169 B2
(45) Date of Patent: Nov. 16, 2004

(54) SERVICE UNIT FOR RESTARTING THE SPINNING OF WORK STATIONS IN AN OPEN-END SPINNING MACHINE

(75) Inventor: Paul Straaten, Schwalmtal (DE)

(73) Assignee: W. Schlafhorst AG & Co. (DE)

( * ) Notice: Subject to any disclaimer, the term of this patent is extended or adjusted under 35 U.S.C. 154(b) by 202 days.

(21) Appl. No.: 10/215,434

(22) Filed: Aug. 9, 2002

(65) Prior Publication Data

US 2003/0029153 A1 Feb. 13, 2003

(30) Foreign Application Priority Data

Aug. 9, 2001 (DE) ..... 101 39 072

(51) Int. Cl.[7] ..... D01H 4/50

(52) U.S. Cl. ..... 57/263; 57/22; 242/475.1

(58) Field of Search ..... 57/22, 23, 261, 57/263, 279, 280; 242/470, 487.6, 473.5–473.7, 476.6, 475.7

(56) References Cited

U.S. PATENT DOCUMENTS

| | | | | |
|---|---|---|---|---|
| 4,299,357 A | * | 11/1981 | Munker | 242/476.6 |
| 4,591,105 A | * | 5/1986 | Niederer | 242/473.5 |
| 5,248,103 A | * | 9/1993 | Polnik | 242/476.6 |
| 5,473,879 A | | 12/1995 | Gobbels et al. | 57/263 |
| 5,634,602 A | | 6/1997 | Gobbels et al. | 242/18 |
| 5,634,603 A | * | 6/1997 | Raasch et al. | 242/473.6 |
| 5,681,000 A | | 10/1997 | Gobbels et al. | 242/18 |

FOREIGN PATENT DOCUMENTS

| | | |
|---|---|---|
| DE | 25 01 735 | 7/1976 |
| DE | 40 28 465 A1 | 3/1992 |
| DE | 43 13 523 A1 | 10/1994 |
| DE | 44 32 702 A1 | 3/1996 |
| DE | 44 43 818 A1 | 6/1996 |
| GB | 1 528 642 | 10/1978 |

OTHER PUBLICATIONS

German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A service unit for restarting a spinning operation at work stations (2) of an open-end spinning machine (1) after replacement of a cheese (8) with an empty tube in the winding device of a work station, comprises an auxiliary yarn supply device (21) and a yarn moving device (23) for fixing a new spinning yarn on the tube. The yarn moving device (23) is movable from a resting position (R) entraining the auxiliary yarn (24) to the winding device (4), and, after restarting the spinning operation, for positioning the yarn (7) connected to the auxiliary yarn (24) in a slot created by a tube plate opener (32) of the service unit between one of the tube plates (30) of the winding device (4) and an end of the tube (10). The yarn (7) is subsequently severed by a cutting device (31), and stored intermediately in a storage device (55).

9 Claims, 8 Drawing Sheets

SERVICE UNIT FOR RESTARTING THE SPINNING OF WORK STATIONS IN AN OPEN-END SPINNING MACHINE

CROSS-REFERENCES TO RELATED APPLICATIONS

This application claims the benefit of German patent application 10139072.6, filed Aug. 9, 2001, herein incorporated by reference.

BACKGROUND OF THE INVENTION

The present invention relates generally to a service unit for restarting a spinning operation in work stations of an open-end spinning machine after replacement of a yarn cheese with an empty cheese-winding tube, and more particularly to a service unit comprising an auxiliary yarn supply device for providing an auxiliary yarn for restarting the spinning operation after a yarn cheese replacement and a yarn moving device for fixing a new spinning yarn on the new empty cheese-winding tube.

As is known, open-end spinning machines have a plurality of adjacent work stations, each of which comprises a spinning device for manufacturing a yarn and comprises a winding device with a creel and a yarn traversing device for producing a cross-wound bobbin commonly referred to as a cheese.

The work stations of such open-end spinning machines are typically served by automatically operating service units that intervene if a need for service has occurred at one of the work stations. Such a need for service occurs, e.g., in case of a yarn break or if the cheese at one of the work stations has attained its prescribed diameter and must be replaced by a new empty tube.

That is, such service units described, e.g., in German Patent Publication DE 44 43 818 A1 or in DE 43 13 523 A1 not only eliminate yarn breaks but also automatically carry out cheese/empty tube replacements. For example, in the case of a cheese/empty tube replacement, the full cheese is removed from the creel of the particular work station and transferred onto a transport device of the machine. Then, a new, empty tube is placed into the creel, the open-end spinning device started to spin again by means of a so-called auxiliary yarn and the new spinning yarn is fixed on-the freshly replaced empty tube.

The known service units comprise numerous manipulation devices, e.g., a pivotably supported, vacuum-loadable suction nozzle for grasping a trailing yarn wound onto the cheese in the case of a yarn break, and a supply device with a pivotably supported supply tube for making available an auxiliary yarn required after a cheese/empty tube replacement for a spinning restart. Moreover, these service units comprise a yarn placement device for fixing the new spinning yarn on the empty tube and for creating a yarn reserve winding. The new spinning yarn is moved by the yarn moving device into the range of one of the tube plates of the creel in such a manner that a rotating yarn catch device arranged on the tube plate grasps the spinning yarn, draws the yarn into an entrainment groove and fixes the yarn to a greater or lesser extent. Subsequently, a starting reserve winding is prepared by the yarn moving device in the area of the foot of the new tube.

The described service units have proved themselves in principle in practice. However, the manner in which the spinning yarn is overtaken by the rotating yarn catch device as well as the separating of the spinning yarn which is initially still running into the supply tube have proved to be disadvantageous. That is, both the undefined overtaking of the spinning yarn by the yarn catch device as well as the somewhat unreliable separating of the spinning yarn often result in relatively long yarn ends that are not fixed on the empty tube. These long, unsecured yarn ends have often proven to be problematic during the subsequent winding process since they frequently wind around component parts, which then results in a destruction of the start reserve winding. The relatively long yarn end can also get into or be wound under the bobbin winding preventing the yarn from subsequently being grasped when the yarn reserve is required. In addition, there is the danger that the yarn end can be removed by the suction of the suction nozzle and disposed of upon a yarn break, especially if the cheese still has a relatively small diameter.

SUMMARY OF THE INVENTION

In light of the above-discussed state of the art, it is accordingly an object of the present invention to provide a service unit whose yarn moving device makes possible an orderly, reliable and reproducible fixation of the spinning yarn on an empty tube held in the creel of a winding device.

The invention addresses this objective by providing a service unit for restarting a spinning operation in work stations of an open-end spinning machine after replacement of a yarn cheese with an empty cheese-winding tube. Basically, the spinning machine comprises multiple work stations, each work station having a spinning device for producing a yarn and a winding device for winding the yarn into a cheese, with each winding device comprising a creel having spaced tube plates for supporting the cheese-winding tube. The service unit comprises an auxiliary yarn supply device for providing an auxiliary yarn for restarting the spinning operation after a replacement of a yarn cheese with an empty cheese-winding tube and a yarn moving device for fixing a new spinning yarn on the empty cheese-winding tube held in the creel of the winding device. The service unit has a tube plate opener operative for creating a slotted opening between one of the tube plates of the winding device and an adjacent end of the cheese-winding tube. In accordance with the present invention, the yarn moving device is arranged for movement from a resting position entraining the auxiliary yarn held by the auxiliary yarn supply device into the area of the winding device and for positioning in the slotted opening the spinning yarn connected to the auxiliary yarn after restarting the spinning operation, the tube plate opener being arranged for subsequently closing the slotted opening to clamp the spinning yarn, the service unit having a yarn cutting device for separating the spinning yarn from the auxiliary yarn and a storage device for intermediately storing the spinning yarn.

Service units with a yarn moving device arranged and designed in accordance with the present invention have the particular advantage that they reliably assure that the new spinning yarn is always fixed in a secure and reproducible manner on the empty tube held in the creel and that the unsecured yarn end is relatively short. That is, the new spinning yarn connected after the spinning restart via a so-called spinning start yarn to the auxiliary yarn by the new yarn moving device can be positioned in such a manner in the area of the winding device and the creel can be loaded in such a manner that a yarn strand held in the creel extends between one of the tube plates of the somewhat open creel and between the adjacent front side of an empty tube held in the creel. The spinning yarn is clamped between the tube plate and the empty tube by a subsequent closing of the creel and thereby is immediately and reliably fixed. In addition, the spinning yarn is separated immediately behind the empty tube so that the free yarn end is always only relatively short. The spinning yarn that continues to run in during the clamping is intermediately stored thereby in a storage device.

In an advantageous embodiment, the yarn moving device comprises functional elements which can be shifted approximately axially to the axis of rotation of the empty tube and guide the new spinning yarn in such a manner onto the empty tube that it forms the desired yarn reserve winding thereat. That is, a yarn reserve winding is produced that reliably remains in its given position during the winding process as well as during subsequent transport procedures but is readily accessible and can be easily detached in case of need.

In a preferred embodiment, the yarn moving device also comprises a carrier arm that is supported in such a manner that it can pivot to a limited extent and can be axially shifted, on the end of which carrier arm are arranged functional elements that can be controlled in a defined manner. Both the carrier arm and the functional elements are designed to be relatively simple but robust and thus not very susceptible to problems.

Moreover, the yarn moving device is supported so that it can rotate to a limited extent and also shift axially, preferably relative to a pivot axis. That is, the radial and the axial movement of the yarn moving device take place via a separate defined drive for each that can be controlled in a defined manner. The drives are designed in an advantageous embodiment as thrust piston transmissions. Such thrust piston transmissions have the advantage that the end points of a movement can be reached at all times in a reproducible manner, especially without additional sensor devices or the like. In addition, such thrust piston transmissions are characterized by a long service life and excellent reliability.

Thus, the carrier arm can be pivoted by such a thrust piston transmission without problems and at any time in an exactly reproducible manner between a rear rest position and a front work position.

A corresponding thrust piston transmission in the area of the pivot axis makes possible an axial movement of the carrier arm, e.g., in order to open the creel. That is, the yarn moving device can be moved axially in such a manner by this thrust piston transmission that a tube plate opener arranged on a head element of the yarn moving device and resting on one of the tube plates of the creel of the winding device presses the tube plate outward. The tube plate involved is tilted in such a manner that a wedge-shaped slot is formed between the tube plate and a front surface of the empty tube held in the creel into which slot a portion of the auxiliary yarn or of the new spinning yarn can be placed.

The portion of the spinning yarn or of the auxiliary yarn extends in this instance between a deflection roller fixed on the yarn placing head and between a spring-loaded yarn guide device arranged on the head element.

The movement of the yarn strand into the wedge-shaped slot preferably takes place by a simple pivoting of a yarn placing head pivotably supported on the head element. That is, the yarn placing head is supported in such a manner that it can pivot in a limited fashion about a pivot shaft, and can be pivoted downwardly by a drive, e.g., a thrust piston transmission, in such a manner that a yarn portion is stretched between the front side of the empty tube and the tube plate.

Preferably, the yarn placing head comprises various functional elements, e.g., a yarn cutting device and a yarn brake. The yarn cutting device and the yarn brake can be actuated with preference by a common drive that is also fixed to the yarn placing head. A thrust piston transmission can also be provided as the drive.

Further details, features and advantages of the present invention will be described and understood from the following disclosure of an exemplary embodiment with reference to the accompanying drawings.

DESCRIPTION OF THE PREFERRED EMBODIMENT

Figure 1:
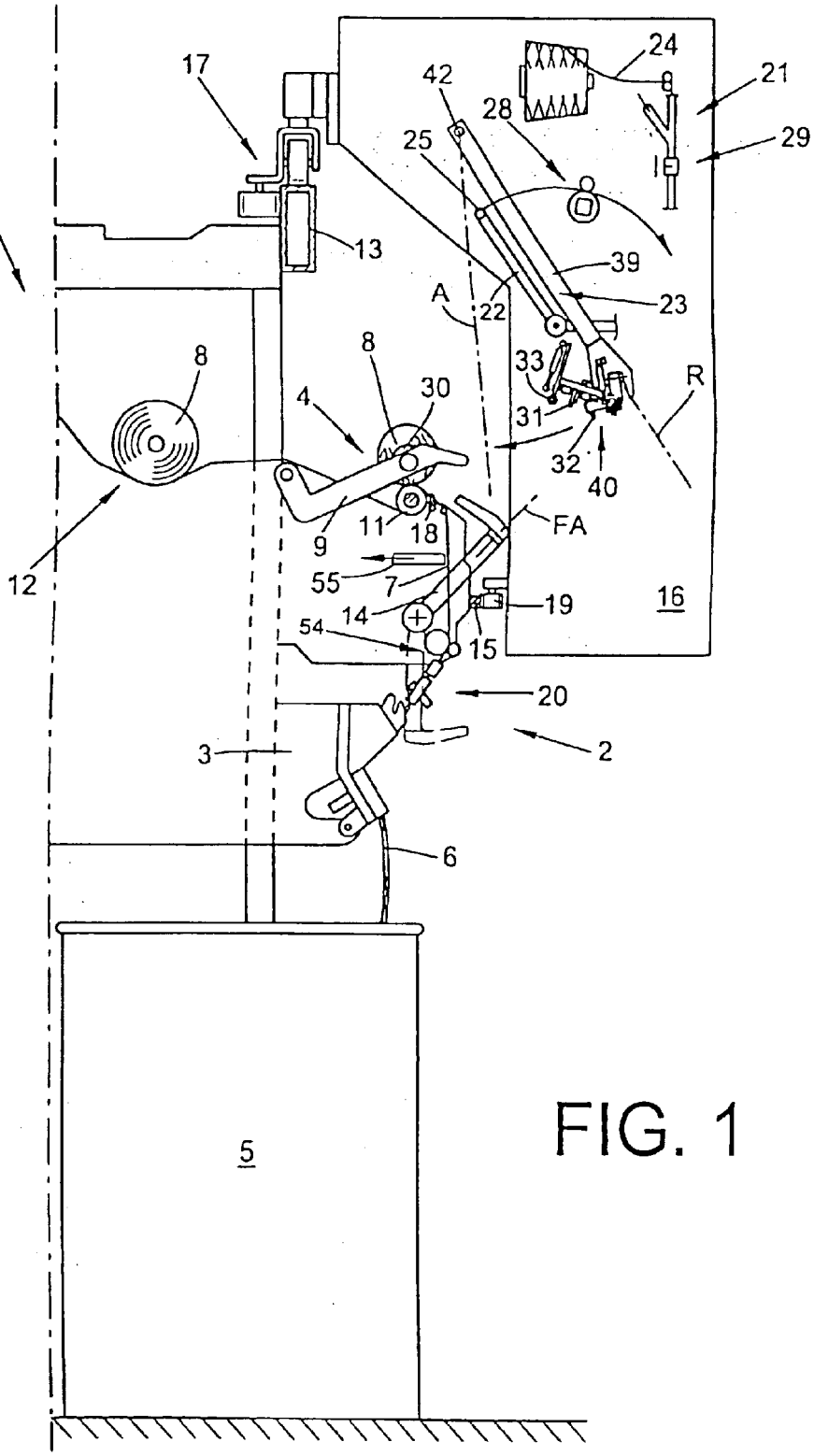
FIG. 1 is a schematic elevational view of one half of an open-end spinning machine equipped with a service unit comprising the yarn placing device in accordance with the present invention.

One half of a known open-end spinning machine is indicated in FIG. 1 and identified as a whole at 1. Such spinning machines comprise a plurality of work stations 2, each of which is provided with a spinning device 3 and a winding device 4.

In spinning devices 3, a sliver 6 contained in spinning cans 5 is spun to yarns 7 that are wound on winding devices 4 to cheeses 8. As indicated, winding devices 4 are each equipped with a creel 9 for rotatably holding an empty cheese-winding tube 10 or a yarn-wound cheese 8 and with a winding drum 11 for driving the cheese.

Moreover, work stations 2 each comprise a yarn traversing device 18, a suction nozzle 14 forming part of the work station and further comprise a spinning start member 20 forming part of the work station. That is, work stations 2 are equipped in such a manner that they can automatically eliminate yarn breaks.

In addition, open-end spinning machine 1 comprises bobbin transport device 12 for removing cheeses 8 completed on winding devices 4.

Service unit 16 is movably arranged next to or on spinning machine 1 on guide rail 13 and support rail 15. The travel mechanism of this service unit 16 is comprised of running rollers 17 and support wheel 19. The service unit is supplied with electrical energy preferably via a sliding contact device or via a drag chain. Such service units 16 travel constantly along open-end spinning machine 1 and intervene automatically when a need for action arises at one of work stations 2, e.g., when a full cheese must be replaced at one of work stations 2 by a new, empty tube and a new spinning start must be made.

Service unit 16 comprises to this end, as is known, numerous manipulating devices that make possible an orderly replacement of cheeses by empty tubes. Of these numerous manipulating devices, only a so-called yarn supply tube 22 with its connected auxiliary yarn supply device 21 and only yarn placing device 23 of the invention are shown in the drawings for the sake of clarity.

Figure 3:
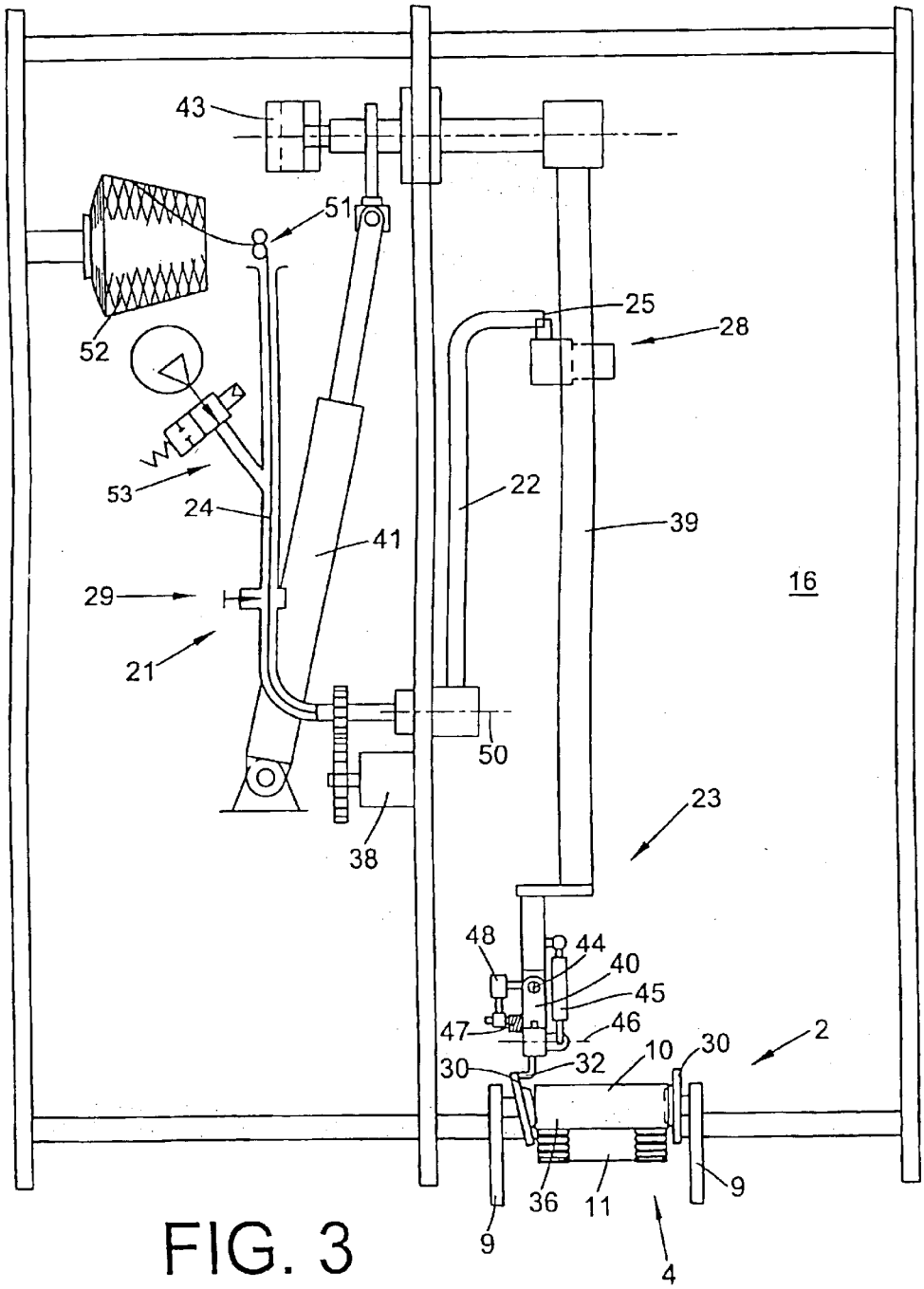
FIG. 3 is an elevational view in partial section of the service unit according to FIG. 2*d* viewed in the direction of arrow X.
Figure 4:
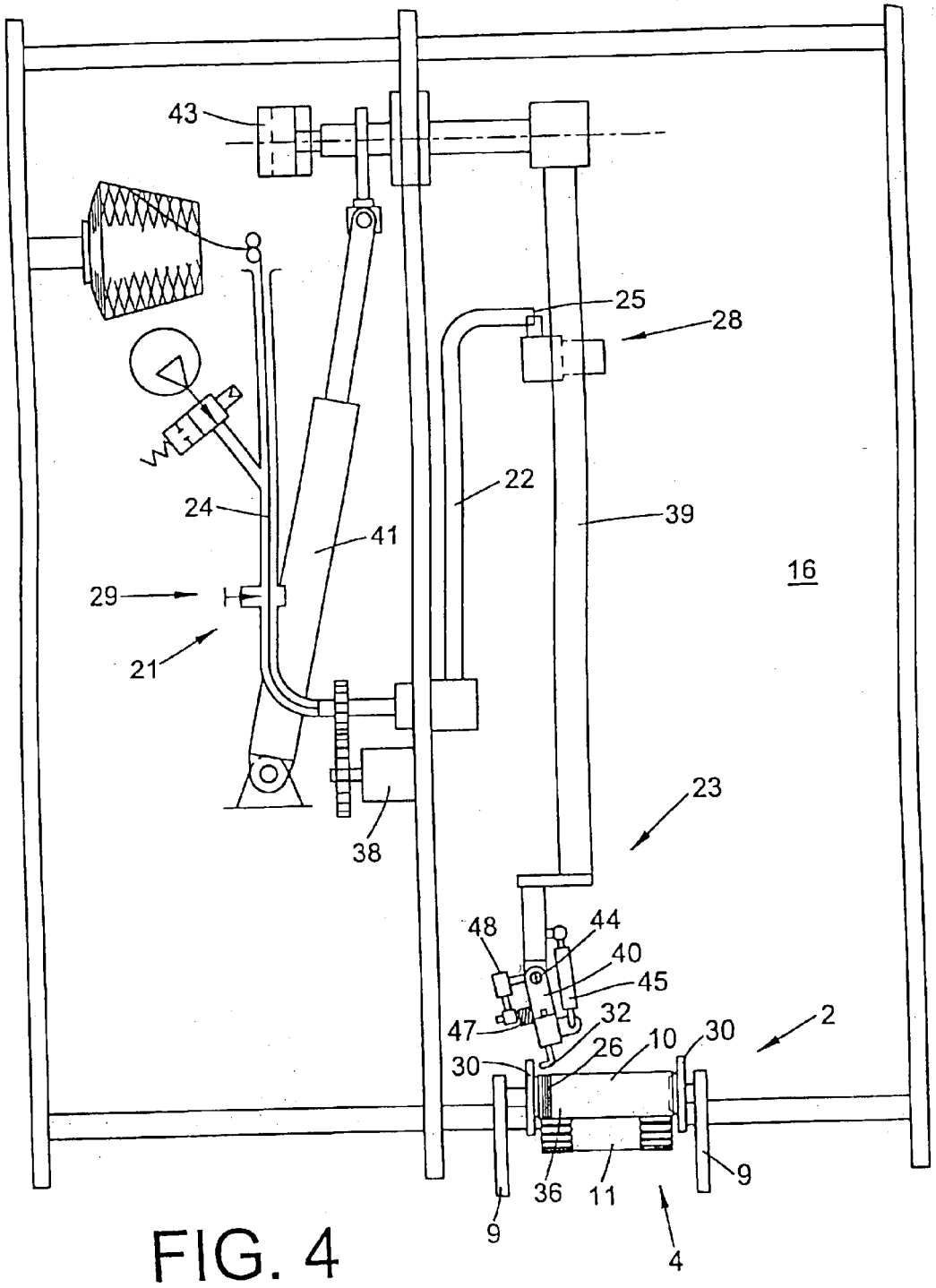
FIG. 4 is an elevational view of the service unit according to FIG. 3 at a somewhat later point in time of the spinning restart operation.

As is indicated in FIGS. 3 and 4 using a rotatably supported supply tube 22, supply tube 22 is rotatably supported, e.g., about pivot axis 50, in an intermediate wall of service unit 16 and can be controlled in a defined manner by stepping motor 38. In this instance, auxiliary yarn supply device 21, that makes auxiliary yarn 24 available, is connected to supply tube 22 via a rotary transmission. Auxiliary yarn supply device 21 basically operates mechanically as well as pneumatically. That is, mechanical supply mechanism 51 is arranged in the area of storage bobbin 52 and draws auxiliary yarn 24 off of supply bobbin 52. The feed of auxiliary yarn 24 preferably takes place pneumatically inside the tube system and/or hose system of auxiliary yarn supply device 21. To this end, auxiliary yarn supply device 21 comprises injector nozzle 53.

Moreover, yarn cutting device 29 is installed in the area of the tube system of auxiliary yarn supply device 21 and cuts auxiliary yarn 14 after its final transfer to suction nozzle 14.

Figure 2A:
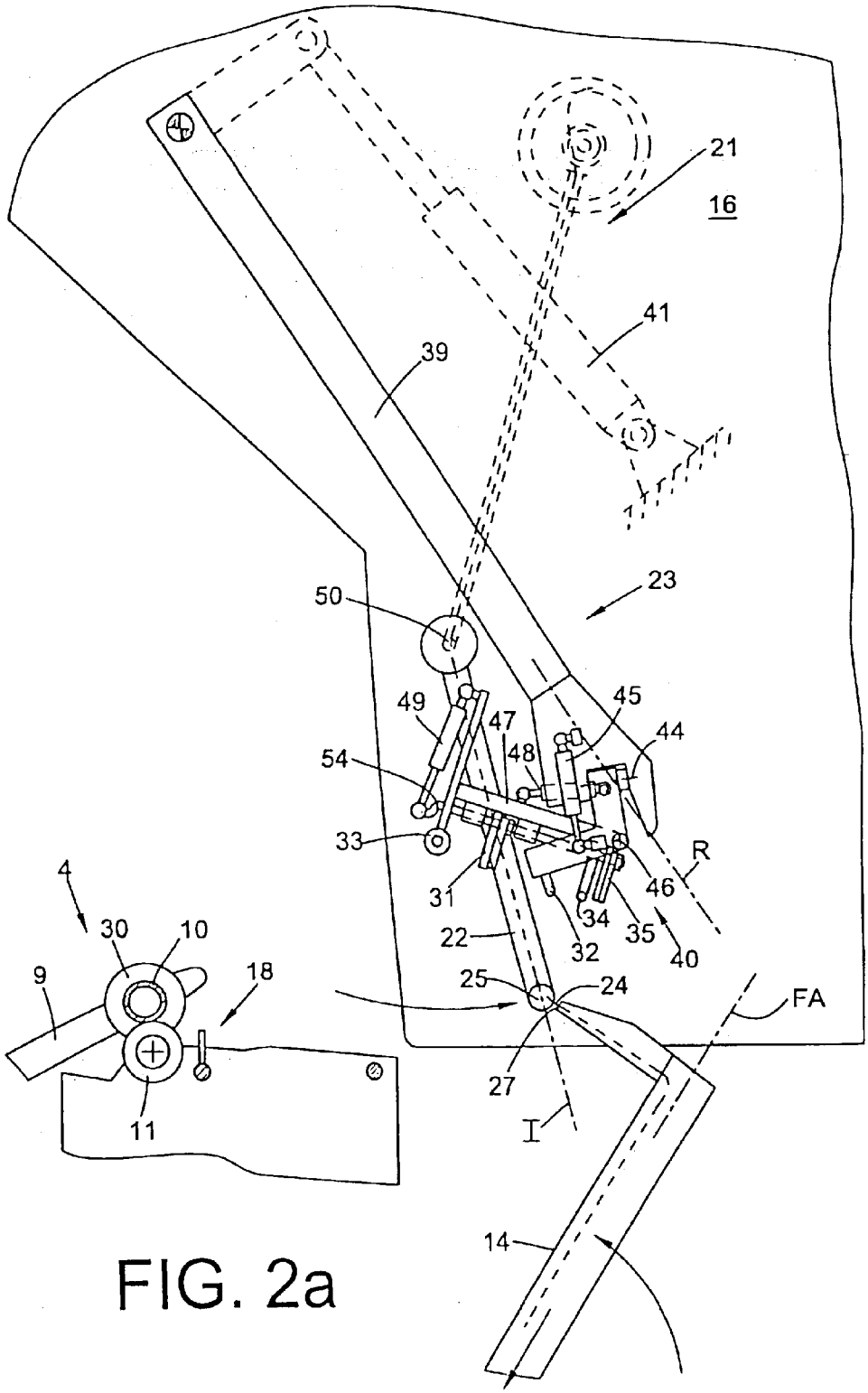
FIGS. 2*a*–2*d* are more detailed schematic elevational views of the service unit and the winding device of the work station of FIG. 1, showing the individual method steps during the restarting of spinning or the transfer of a spinning yarn into the area of the creel such as occur during the use of the service unit indicated in FIG. 1.
Figure 2B:
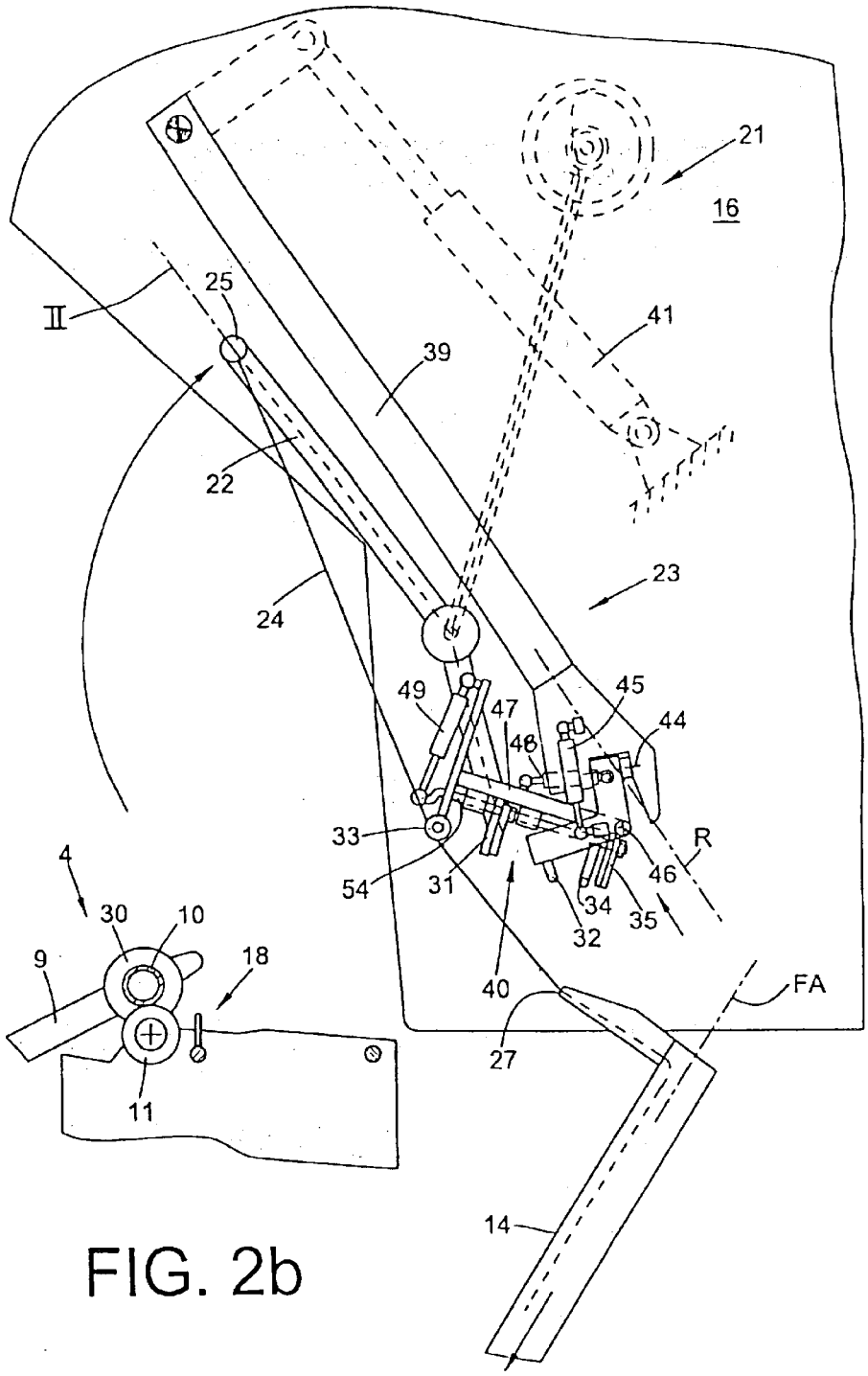

As FIG. 2*a* shows, mouth 25 of supply tube 22 can be positioned in an operating position I in which suction nozzle 14 of the work station can take auxiliary yarn 24 from supply tube 22. Mouth 25 of supply tube 22 can be subsequently pivoted into an operating position II, as indicated in FIG. 2*b*. In operating position II, auxiliary yarn 24 extending between spinning start member 20 of the work station and between mouth 25 of supply tube 22 can be grasped by yarn moving device 23 in accordance with the invention and be moved into the area of winding device 4.

Yarn moving device 23 is comprised substantially of carrier arm 39 also supported in an intermediate wall of service unit 16. Carrier arm 39 comprises head element 40 on its end and is supported at its pivot shaft in such a manner that it can be rotated to a limited extent and also moved axially. The radial pivoting of carrier arm 39 between resting position R and work position A takes place via thrust piston transmission 41, while thrust piston transmission 43 is provided for the axial moving of carrier arm 39.

As is apparent from the drawings, head element 40 is connected via pivot shaft 44 to carrier arm 39 and can be pivoted to the side via thrust piston transmission 45. Tube plate opener 32 as well as spring-loaded yarn guidance device 34 are fastened to head element 40. Moreover, yarn piecing head 47 is movably articulated to head element 40 via pivot shaft 46 and carries various functional elements such as yarn cutting device 31, deflection roller 33 and yarn brake 35. Further, yarn joining head 47 can be pivoted by thrust piston transmission 48 and can be pivoted as required out of the position shown in FIG. 2*d* into the position shown in FIG. 2*d*.

In order to actuate yarn cutting device 31 and yarn brake 35, thrust piston transmission 49 is provided for controlling the previously cited functional elements via linkage 54. The actuation of spring-loaded yarn guidance device 34 arranged in the area of yarn brake 35 takes place automatically during the pivoting in of yarn joining head 47. Specifically, during the pivoting in of yarn joining head 47, spring-loaded yarn guidance device 34 is moved automatically via an appropriate stop into its work position.

Figure 5:
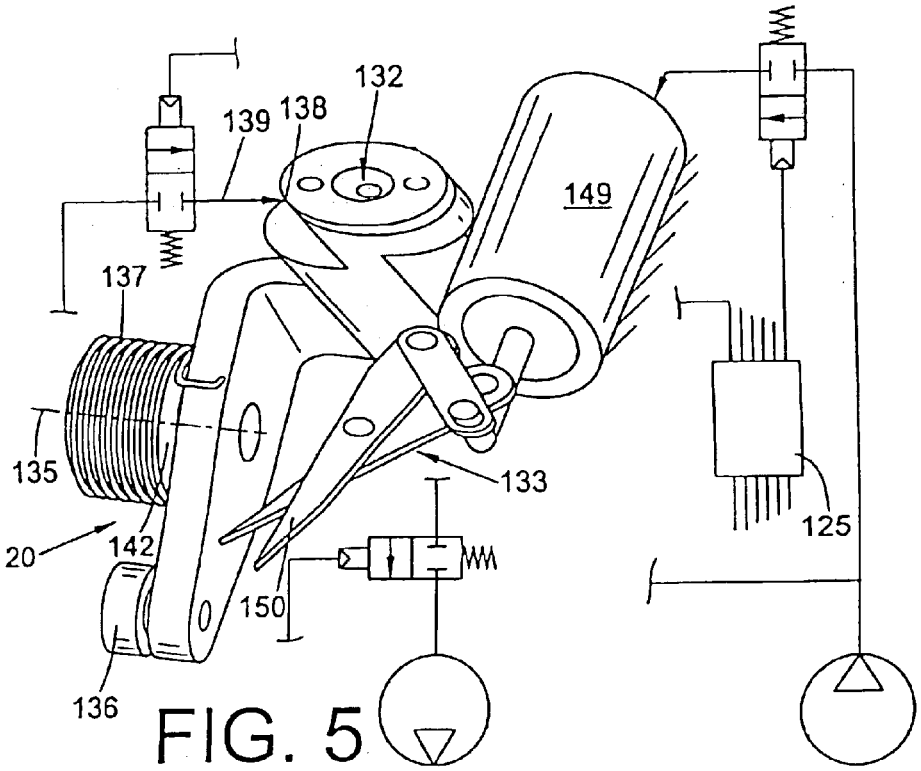
FIGS. 5 and 6 are perspective and sectional views of a spinning start member forming part of the work station.
Figure 6:
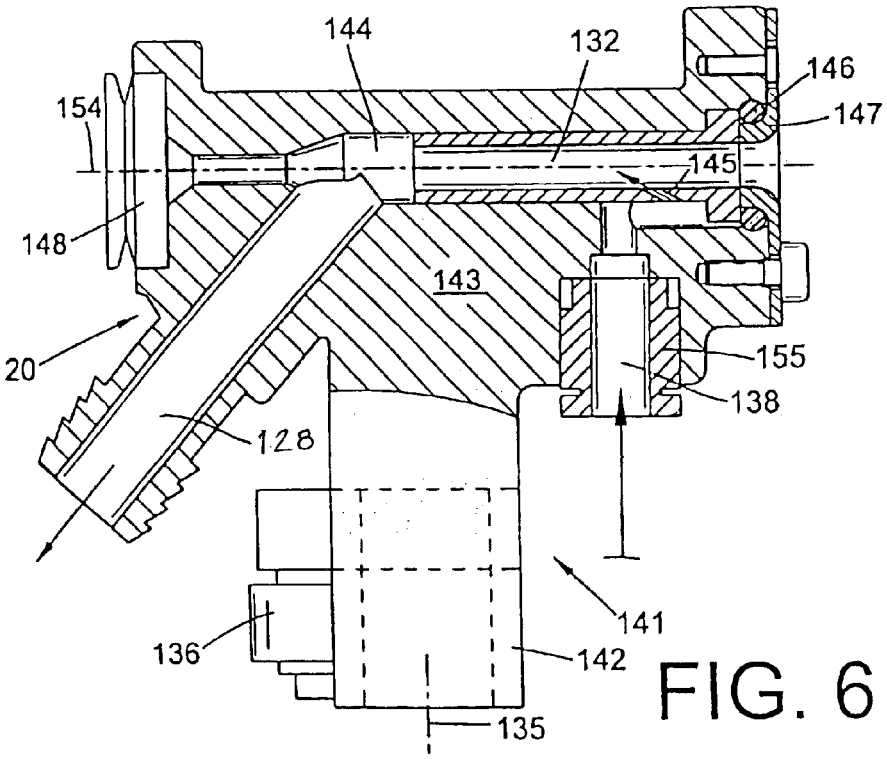

FIGS. 5, 6 show spinning start member 20 of the work station. Spinning start member 20 takes auxiliary yarn 24 moved by suction nozzle 14, prepares it and holds it available for the spinning restart process. Spinning start member 20 is comprised substantially of foundation 141, preferably produced in an injection molding or die-casting process and comprising, among other things, cylindrical shoulder 142 for receiving spring element 137.

Pivot axis 135 of spinning start member 20 is also located in the area of this cylindrical shoulder 142. In addition, foundation 141 comprises a connecting bore on its end for fastening stop 136, whereas on the opposite side of foundation 141 a receiving housing 143 for yarn opening tube 132 is arranged. Receiving housing 143 for yarn opening tube 132 comprises stepped passage bore 144 to which a vacuum connection 129 and a compressed air connection 138 are connected. Moreover, a rapid coupling device 155 can be arranged in the area of compressed air connection 138.

Yarn opening tube 132 is fixed in passage bore 144 and comprises, as is known, one or several tangential bores 145 through which a flow of compressed air can be applied on the end of auxiliary yarn 24 pneumatically fixed in yarn opening tube 132 and during which the yarn twist can be opened. As is apparent from FIG. 8 in particular, yarn opening tube 132 is fixed via O-ring seal 146 or the like as well as boltable cover sheet 147 in passage bore 144. Seal 148 is provided on the opposite side of passage bore 144 bordering open-end spinning device 2. In addition spinning start member 20 comprises pneumatically actuable yarn cutting device 133. That is, scissors 150 or the like are connected to thrust piston transmission 149 that can be controlled in a defined manner via work station computer 125.

The operation of the device in accordance with the invention will thus be explained and understood as follows.

When a cheese 8 has attained its set diameter at one of work stations 2, service unit 16 is ordered to the particular work station 2 concerned and replaces the full cheese 8 thereat automatically with a new empty tube 10. Specifically, after the ejection of the full cheese 8, a new empty tube 10 is placed at first between tube plates 30 of creel 9 of the particular work station 2 by appropriate (not shown) manipulating devices of service unit 16. This situation is schematically shown in FIG. 2*a*.

Then, in order to restart the spinning of work station 2, suction nozzle 14 forming part of the work station is pivoted into yarn take-up position FA. At the same time, supply tube 22 of service unit 16 is rotated by stepping motor 38 about pivot shaft 50 such that mouth 25 of supply tube 22 is positioned in front of suction intake opening 27 of suction nozzle 14. Thus, supply tube 22 assumes its operating position I.

Supply tube 22 is connected to auxiliary yarn supply device 21, as explained above, and is now loaded pneumatically in such a manner that auxiliary yarn 24 exits out of mouth 25 of supply tube 22. Exiting auxiliary yarn 24 is immediately drawn by suction, as indicated in FIG. 2*a*, by vacuum-loaded suction nozzle 14 of work station 2.

Yarn moving device 23 is still positioned in its rest position R at this point in time, as indicated. Supply tube 22 is subsequently pivoted into the second, upper operating position II (FIG. 2*b*). Auxiliary yarn 24 is subsequently appropriately supplied thereby by auxiliary yarn supply device 21. During the pivoting of supply tube 22 into operating position II, the auxiliary yarn is drawn over deflection roller 33 of yarn moving device 23, that is still positioned at this point in time in its rest position R.

Figure 2C:
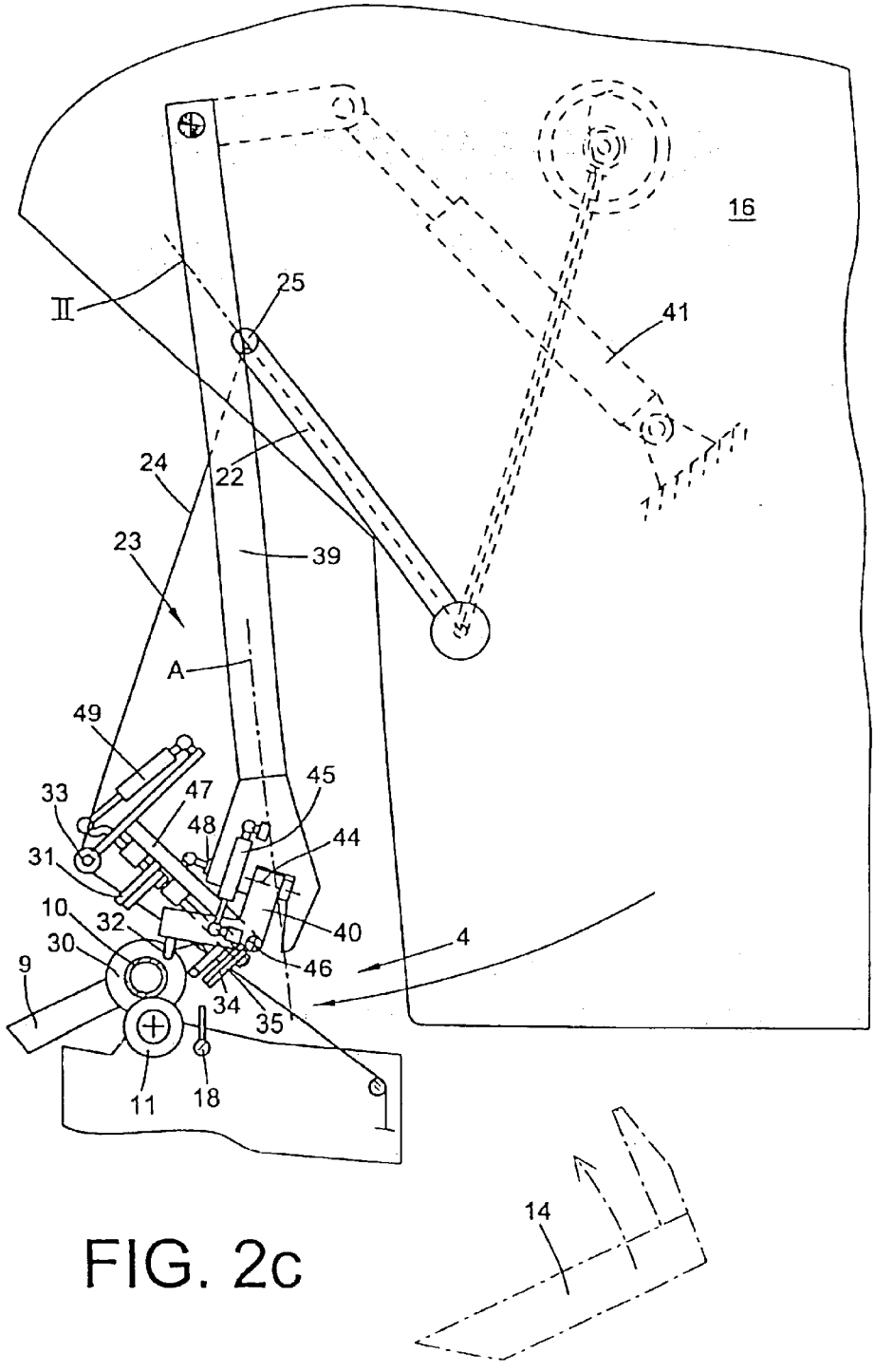
Figure 2D:
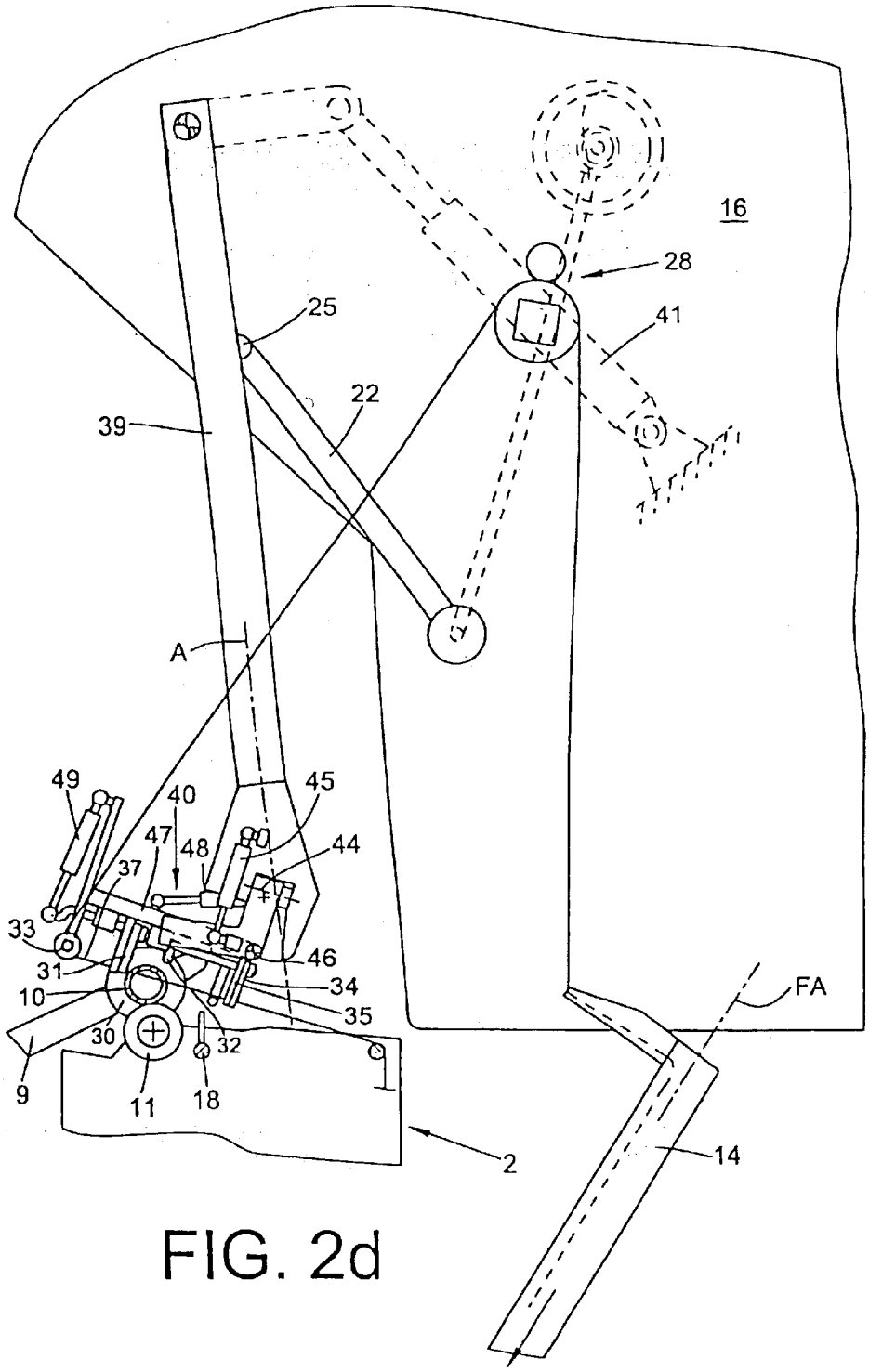

In the next step, thrust piston transmission 41 is controlled in such a manner that yarn moving device 23 is pivoted forward into its work position A. Auxiliary yarn 24 is threaded thereby into yarn cutting device 31 arranged on yarn moving device 23 as well as into yarn brake 35. At the same time, suction nozzle 14, that pneumatically fixes the starting end of auxiliary yarn 24, is pivoted downwardly into the position shown in dotted lines in FIG. 1 and transfers auxiliary yarn 24 to spinning start member 20 of work station 2. The end of auxiliary yarn 24 is prepared for the subsequent spinning start process and the auxiliary yarn is held available for the spinning start process in an appropriate yarn preparation device of spinning start member 20, preferably in a known, pneumatically loadable preparation tube. The suction nozzle, which is now free, pivots back upwardly, as is indicated in FIG. 2*c*.

Supply tube 22 subsequently pivots further and re-attains operating position I. During the course of this pivoting movement of supply tube 22, auxiliary yarn 24 is placed into yarn draw-off device 28, which can either be designed as a mechanically operating roller supply mechanism, as in the exemplary embodiment, or operates pneumatically. In this instance, e.g., an injector supply device is provided.

In addition, during the pivoting movements of supply tube 22 into its operating positions, an appropriately coordinated length of auxiliary yarn is constantly re-supplied via a yarn supply mechanism arranged, e.g., at the input side of auxiliary yarn supply device 21.

While supply tube 22 is being pivoted back into its operating position I, suction nozzle 14, which has transferred auxiliary yarn 24 to spinning start member 20 of work station 2 and is also now free, is pivoted upward again and is again in its yarn take-up position FA.

Auxiliary yarn 24 is now separated by yarn cutting device arranged inside auxiliary yarn supply device 12 and exits on account of the prevailing blown air current out of mouth 25 of supply tube 22, during which it is immediately drawn into suction nozzle 14 on account of the vacuum present in the area of suction intake opening 27 of suction nozzle 14.

Thus, auxiliary yarn 24 is now held between spinning start member 20 of work station 2 and between suction nozzle 14 of the work station and runs through yarn moving device 23, through yarn draw-off device 54 of work station 2 and through yarn draw-off device 28 of service unit 16.

Yarn moving device 23 is subsequently loaded axially by thrust piston transmission 43. Yarn moving device 23 is thereby positioned with a stop element (not shown) on the housing of winding device 4 and tilts tube plate 30 somewhat outwardly with tube plate opener 32 resting on this tube plate 30 of creel 9. A wedge-shaped slot is produced thereby between tube plate 30 and the front side of tube foot 36 of empty tube 10 held in creel 9 into which slot a portion 37 of auxiliary yarn 24 is subsequently placed by a pivoting movement of yarn joining head 47.

That is, yarn joining head 47 is pivoted forwardly about pivot shaft 46 by thrust piston transmission 48, as indicated in FIG. 2*e*, so that auxiliary yarn 24 forms a yarn portion 37 in front of the front side of tube foot 36. Yarn portion 37 extends, as apparent from FIG. 2*d*, through yarn cutting device 31 and yarn brake 35 and is secured by yarn guide device 34, which was actuated during the pivoting of yarn joining head 47.

In order to restart the spinning operation of spinning device 3, prepared yarn end of auxiliary yarn 24, which end is held available by spinning start member 20 of work station 2, is at first fed back briefly into spinning device 3 and a fiber ring circulating there is broken. Auxiliary yarn 24, that is connected via a so-called spinning start yarn to new spinning yarn 7, is subsequently drawn off via yarn draw-of device 54 (indicated in FIG. 1) of work station 2 as well as via approximately synchronously running yarn draw-off device 28 of service unit 16 and immediately removed by suction nozzle 14 of work station 2. This removal runs until the spinning start yarn passes a sensor device (not shown). When the spinning start yarn has run through, the actual placing of spinning yarn 7 on empty tube 10 as well as the winding of yarn reserve 26 onto empty tube 10 take place.

That is, a few rapid movements now take place immediately one after the other. During this time the yarn briefly stands still on tube plate 30. Since the spinning device is continuously producing spinning yarn 7 at the same time, this spinning yarn is briefly stored in an intermediate fashion in storage nozzle 55 of work station 2.

In particular, the following method steps result especially for the clamping of the new spinning yarn 7 between tube plate 30 and empty tube 20 as well as for the production of yarn reserve 26 on empty tube 10.

The new spinning yarn 7 is cut by yarn cutting device 31 just above empty tube 10 and at the same time clamped by yarn brake 35 positioned below empty tube 10. The cut yarn piece still running via yarn withdrawal device 28 is removed via suction nozzle 14. Immediately after or simultaneously with the yarn separation, tube plate 30 is closed by pivoting head element 40 back about pivot shaft 44 and spinning yarn 7 is reliably clamped between empty tube 10 and the front surface of tube foot 36.

Yarn cutting device 31 and yarn brake 35 are then opened by appropriately controlling thrust piston transmission 49. Spinning yarn 7 is positioned in front of the so-called yarn reserve groove of empty tube 10. Winding drum 11 is subsequently started and accelerates empty tube 10 resting thereon via friction to winding speed. After a certain number of tube rotations, e.g., three rotations, yarn brake 35 is closed. Thus, the remaining windings of yarn reserve 26 are wound with an elevated yarn tension and offset a few millimeters to the outside so that the yarn start is overwound and is thus reliably fixed.

After the completion of yarn reserve winding 26, spinning yarn 7 is released by pivoting yarn moving device 23 backwardly and can be taken up by yarn traversing device 18 of work station 2.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A service unit for restarting a spinning operation in work stations of an open-end spinning machine after replacement of a yarn cheese with an empty cheese-winding tube, wherein the spinning machine comprises multiple work stations, each work station having a spinning device for producing a yarn and a winding device for winding the yarn into a cheese, each winding device comprising a creel having spaced tube plates for supporting the cheese-winding tube, the service unit comprising an auxiliary yarn supply device for providing an auxiliary yarn for restarting the spinning operation after a replacement of a yarn cheese with an empty cheese-winding tube and a yarn moving device for fixing a new spinning yarn on the empty cheese-winding tube held in the creel of the winding device, the service unit having a tube plate opener operative for creating a slotted opening between one of the tube plates of the winding device and an adjacent end of the cheese-winding tube, the yarn moving device being arranged for movement from a resting position entraining the auxiliary yarn held by the auxiliary yarn supply device into the area of the winding device and for positioning in the slotted opening the spinning yarn connected to the auxiliary yarn after restarting the spinning operation, the tube plate opener being arranged for subsequently closing the slotted opening to clamp the spinning yarn, the service unit having a yarn cutting device for separating the spinning yarn from the auxiliary yarn and a storage device for intermediately storing the spinning yarn, wherein the yarn moving device comprises operating elements movable in a path having a component of motion axial with respect to an axis of rotation of the cheese-winding tube for producing a reserve yarn winding.

2. The service unit according to claim 1, wherein the yarn moving device comprises operating elements movable generally axially with respect to an axis of rotation of the cheese-winding tube for producing a reserve yarn winding.

3. The service unit according to claim 1, wherein the yarn moving device comprises a carrier arm supported for limited pivotability about a pivot axis and for axial shiftability relative to the cheese-winding tube, the operating elements being supported on an end of the carrier arm.

4. The service unit according to claim 3, wherein a first drive is connected to the carrier arm for pivoting of the carrier arm between the resting position and a work position.

5. The service unit according to claim 3, wherein the carrier arm comprises a second axially engaging drive in the area of its pivot axis.

6. The service unit according to claim 3, wherein the carrier arm supports a head element with a spring-loaded yarn guide device and the tube plate opener for limited pivotability, the head element being pivotable in a defined manner by a third drive.

7. The service unit according to claim 6, wherein a yarn placing head on the head element is rotatably supported on a pivot axis and is pivotable pivoted by a fourth drive.

8. The service unit according to claim 7, wherein the yarn cutting device, a yarn brake and a fifth drive for actuating the yarn cutting device and the yarn brake are arranged on the yarn placing head.

9. The service unit according to claim 8, characterized in that the drives comprise thrust piston transmissions.

* * * * *